343-756 SR
12/11/79 OR 4,178,574

United States Patent [19] [11] 4,178,574
Edens et al. [45] Dec. 11, 1979

[54] HORN ANTENNA WITH ROTATING WAVEGUIDE AND POLARIZATION LENS MEANS

[75] Inventors: Jan W. Edens; Theodorus H. A. M. Vlek; Wilhelmus H. C. Withoos, all of Eindhoven, Netherlands

[73] Assignee: U.S. Philips Corporation, New York, N.Y.

[21] Appl. No.: 867,129

[22] Filed: Jan. 5, 1978

[30] Foreign Application Priority Data

Jan. 12, 1977 [NL] Netherlands ..... 7700230

[51] Int. Cl.[2] ..... H01Q 13/02
[52] U.S. Cl. ..... 343/756; 343/755; 343/772; 343/781 R; 343/909
[58] Field of Search ..... 343/753-755, 343/756, 909, 100 PE, 100 R, 781, 910, 911 R, 911 L, 772

[56] References Cited

U.S. PATENT DOCUMENTS

| | | | |
|---|---|---|---|
| 2,978,702 | 4/1961 | Pakan | 343/773 |
| 3,394,375 | 7/1968 | Vice et al. | 343/756 |
| 3,771,160 | 11/1973 | Laverick | 343/909 |

OTHER PUBLICATIONS

Gandy, C., "A Circularly Polarized Aerial for Satellite Reception", *British Broadcasting Corp.,* BBC RD 1976/21, Aug. 1976, pp. 1-8.

Young et al., "Meander-Line Polarizer", *IEEE* Transactions on Antenna and Propagation, May 1973, pp. 376-378.

*Primary Examiner*—David K. Moore
*Attorney, Agent, or Firm*—Algy Tamoshunas

[57] ABSTRACT

Disclosed is an antenna feed system for use in satellite communication systems and the like, comprising a horn with a rectangular aperture and a waveguide connected thereto. The assembly formed by the waveguide and horn is constructed from two parts secured together so that the junction lies in the longitudinal symmetry plane parallel to the electric field of the $TE_{01}$ mode and is mounted for rotation about the longitudinal axis of the waveguide. The feed system further comprises a polarization converter mounted in front of the horn for rotation about the extention of the longitudinal axis of the waveguide. The converter is constructed from a plurality of layers of supporting material each provided with a conductor which forms in one direction a mainly inductive load and in a direction which is perpendicular thereto a mainly capacitive load.

6 Claims, 10 Drawing Figures

Figure 1:
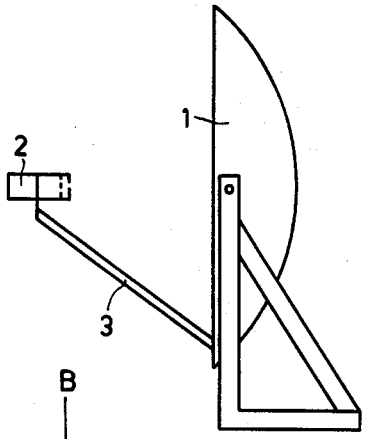

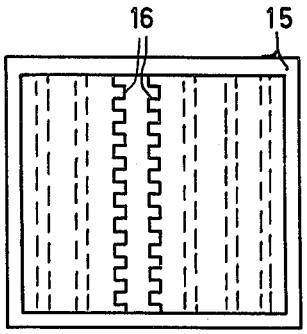
Fig.4
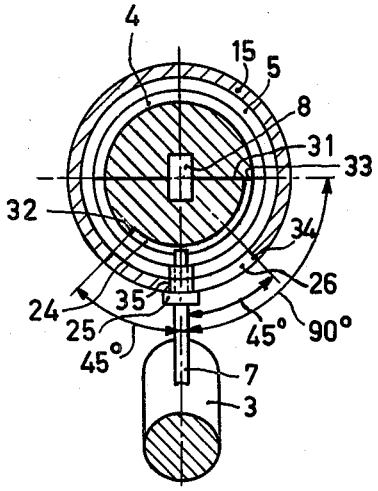
Fig.5
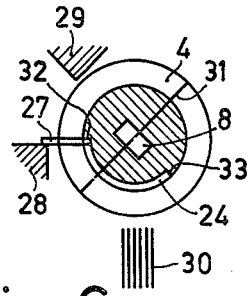
Fig 6a
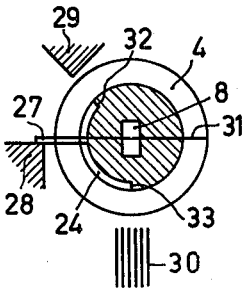
Fig 6b
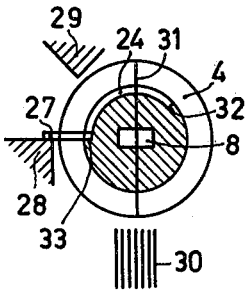
Fig 6c
Fig 6d
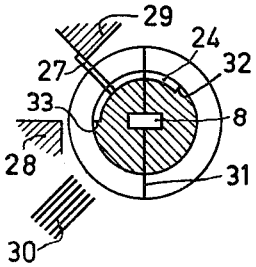
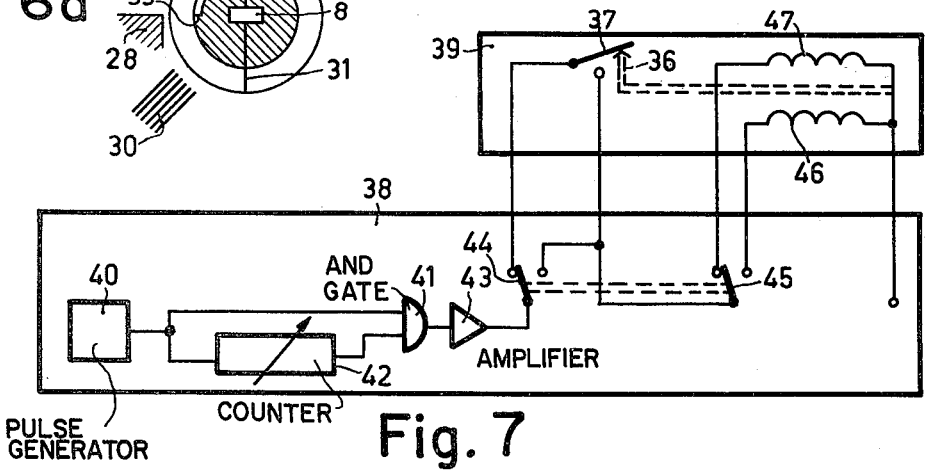
Fig. 7

HORN ANTENNA WITH ROTATING WAVEGUIDE AND POLARIZATION LENS MEANS

The invention relates to an antenna feed system comprising a rectangular waveguide horn with a rectangular aperture and a polarisation converter for converting the polarisation of received signals into a desired polarisation.

Such a feed system is used, inter alia, receiving antennas of satellite communication systems, such as in the transmission of TV-signals having a carrier frequency of 12 GHz.

One problem with such systems is that the radiation beams of near-by satellites partially overlap on the earth's surface. To enable reception of each of the satellite signals individually, signals of near-by satellites have different polarisations.

Circular polarisation is preferably used because with circular polarisation the reception (contrary to a linear polarisation) is not sensitive to the geographical location of the antenna relative to the satellite or transmitter.

A feed arranged for the reception of such signals is disclosed in report No. 21 of the BBC Research Department Engineering Division of August 1976. The feed system described there comprises a polarisation-converter constructed from a circular waveguide. The circular waveguide is provided with a plurality of reactive elements and its end is connected to a horn with a circular aperture. This converter converts the received, circularly polarised, waves into linearly polarised waves, namely into vertically polarised waves for one direction of rotation of the circularly polarised waves and into horizontally polarised waves for the opposite direction of rotation of the circularly polarised waves.

The mutually orthogonal, linearly polarized waves are applied to rectangular waveguides by an orthogonal mode coupling device connected to the feed for further processing.

Due to the complex structure, this feed system is not very suitable for use in receiving antennas of satellite communication systems which operate with narrow bandwidths since only one or one of several signals need be received.

It is an object of the invention to provide a very simple feed arrangement which can be mass produced and is capable of receiving any kind of polarization.

The feed system according to the invention comprises a rectangular waveguide and a horn with a rectangular aperture. The assembly formed by the horn and waveguide is constructed from two parts secured together so that the juncture between the parts lies in the longitudinal symmetry plane parallel to the electric field of the $TE_{01}$ waveguide mode. The feed system further includes a polarisation converter comprising a screen composed of several layers of supporting material each having a conductor pattern applied thereto which forms, for the HF electric field, in the plane of the screen in one direction a mainly inductive load and in a direction perpendicular thereto a mainly capacitive load. The screen is arranged in front of the horn aperture perpendicularly to the extention of the longitudinal axis of the waveguide.

It should here be noted that from the article "Meander-line Polariser" in IEEE Transactions on Antenna and Propagation, May 1973 pages 376–378, a polarisation converter is known per se which comprises a screen composed of several layers of supporting material having a conductor pattern applied on each layer which forms for HF electric field located in the plane of the screen in a given direction a mainly inductive load and a mainly capacitive load in a direction perpendicular thereto.

In accordance with a preferred embodiment, the screen is arranged so that it is rotatable around the longitudinal axis of the waveguide.

In accordance with a further preferred embodiment, the feed system comprises a casing in which the rectangular waveguide and horn assembly is arranged so that it is rotatable around the longitudinal axis of the waveguide relative to the casing. This has the advantage that any type of polarisation can be received.

In accordance with a still further preferred embodiment, the casing is provided with a cylindrical fitting in which the rectangular waveguide configuration or assembly is arranged rotatably and the converter comprises a holder for the screen which is supported rotatably around the fitting. The feed system further includes a motor connected to the casing and directly coupled to one of the components of the group formed by the waveguide and horn assembly and the converter for moving that component by remote control relative to the casing to any desired position. A coupling device is provided for moving by means the one component and the other component over a given angle for adjusting a desired angle between the positions of the two components. This has the advantage that only one motor is required for moving the waveguide configuration and the converter to the desired position by means of remote control.

Figure 2:
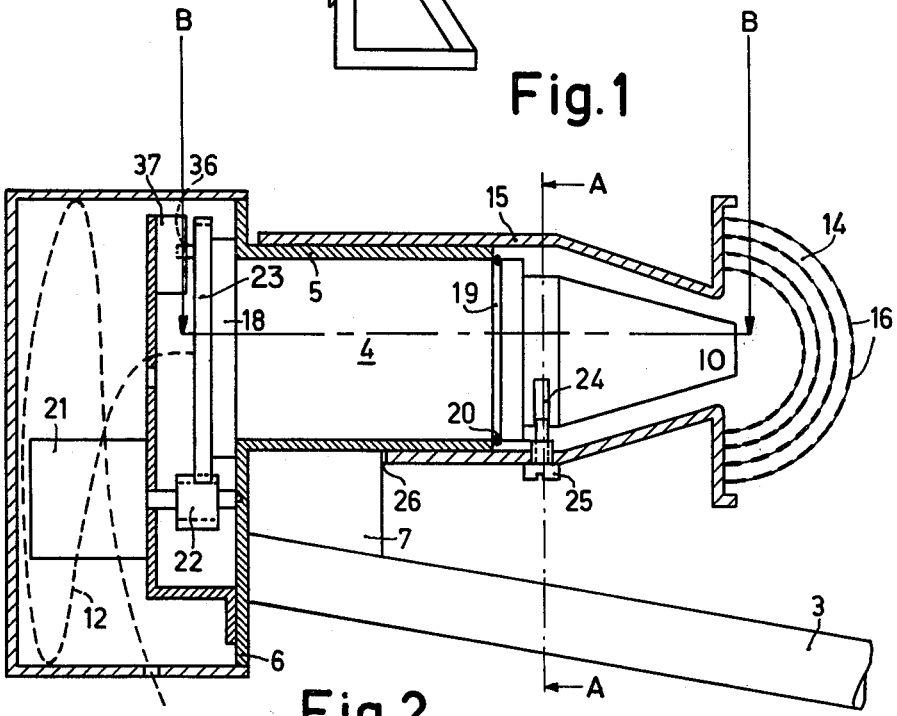
Figure 3:
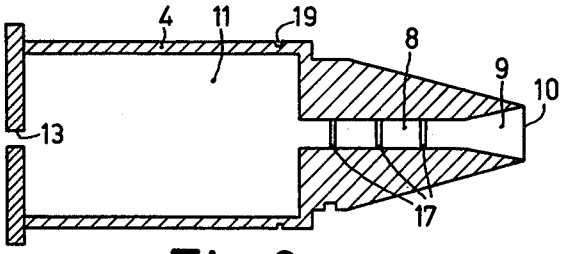

The invention and its advantages will be explained in greater detail with reference to the drawings, in which the corresponding components in the various figures having been given the same reference numerals, wherein:

FIG. 1 shows an antenna comprising a reflector and a feeder arrangement,

FIG. 2 shows a partial cross-section of an elevational view of a feed arrangement according to the invention, FIG. 3 shows a cross-section along line B—B in FIG. 2 of a receiving device constructed partially in the form of a waveguide of the feed arrangement of FIG. 2, FIG. 4 shows a part of a front view of the feed arrangement shown in FIG. 2, FIG. 5 shows a cross-section along the line A—A in FIG. 2, FIGS. *6a* to *6d* inclusive shows schematically some positions of adjustments of the feed arrangement shown in FIG. 2 on the basis of the cross-section shown in FIG. 5 and FIG. 7 shows the circuit diagram of a control circuit for the remote control of the feed arrangement shown in FIG. 2.

FIG. 1 shows an antenna comprising a reflector 1 and a feed arrangement 2. This feed arrangement is used for processing, inter alia, SHF-signals transmitted by satellites and received by the antenna. The feed arrangement is supported by means of a rod 3 arranged in front of the focal point of the reflector 1.

As shown in FIG. 2, the feed arrangement 2 comprises a casing 6 attached to the rod 3 and a cylindrical fitting 5 connected to the casing. For increasing the rigidity, a partition 7 is disposed between the fitting 5 and the rod 3. In addition, the feed arrangement 2 comprises a receiving device 4 which is partially constructed as a rectangular waveguide. FIG. 3 shows a cross-section of the casing of the receiving device 4.

The receiving device 4 comprises a waveguide 8 having a widened end portion which forms a horn 9 with an aperture 10. The receiving device 4 is arranged so that the center of the aperture 10 coincides with the focal point of the reflector 1.

As shown in FIG. 3 the other end of the waveguide 8 opens into a chamber 11 in which a SHF signal processing arrangement, not shown in the drawing, and implemented in microstrip technology can be arranged. This SHF device is directly coupled to the waveguide 8 by means of a microstrip waveguide transducer such as that as described in applicants' Dutch Patent Application 7799/75. The output of the SHF signal processing device is connected to further receiving equipment, not shown, by a coaxial cable 12, which is diagrammatically shown in FIG. 2 by means of a dashed line, which extends through a hole 13 in the casing of the receiving device 4.

An inexpensive feed arrangement for use with several polarisations suitable for mass-production can be obtained by constructing the casing of the receiving device 4 from two halves and by using a special polarisation-converter (14, 15) which is arranged relative to the feed aperture 10.

The fact that the casing of the receiving device consists of two parts has the advantage that each half can be manufactured in a very simple manner from a synthetic resin material, such as acrylonitrile butadine styrene by pressure or injection moulding. The parts are then provided with a thin conducting coating, for example by vacuum deposition of copper, silver or gold. After the two halves are secured together, a very good waveguide configuration 8, 9 and 10 is obtained in a simple and reliable manner.

Pressure or injection moulding of the casing of the receiving device, furthermore, makes it possible to obtain, without additional operations, a waveguide filter which is composed in known manner from a plurality of partitions. In addition, the fact that the housing of the device consists of two parts enables the SHF signal processing arrangement implemented in microstrip technique to be mounted in a very simple manner.

The dividing plane, which coincides with the plane of the drawing of FIG. 2, must not affect the wave propagation in the waveguide. In contradistinction to the receiving device described in the BBC Research Report 21 of 1976, the horn 9 has a rectangular aperture 10 and is connected to the rectangular waveguide 8. Such a waveguide configuration is divisable along the longitudinal symmetry plane which is parallel to the electric field of a $TE_{01}$ mode in the waveguide because this plane does not intersect currents in the waveguide wall.

The rectangular aperture 10 can, however, only be used in conjunction with a specific type of polarisation converter which requires a special arrangement. According to the invention, the polarisation converter 14, 15 is of the type comprising a screen composed of, for example, four layers of supporting material such as polyester, each of the layers being provided with a plurality of printed conductors 16 which are arranged at equal distances from and parallel to each other, as shown by the front view of the screen 14 fully in FIG. 4. This figure fully shows two meander-shaped conductors 16, with the other conductors being shown diagrammatically by dashed lines. A detailed description including dimensions of an example of such a polarisation converter is given in the article "Meander-line Polarizer" by Leo Young, Lloyd A. Robinson and Colin A. Hackin published in IEEE Transactions on Antennas and Propagation, May 1973, pages 376–378.

This polarisation converter operates as follows.

The meander-shaped conductors 16 form, for an electric field parallel to the longitudinal direction of the conductors 16, a mainly inductive load and for an electric field which is in the plane of the conductors 16 traverse of these conductors, a mainly capacitive load. By a suitable choice of the meander dimensions and mutual distance the values of these loads are made equal to each other. In the case of a linearly polarized wave, whose electric field is located in the plane of the conductors 16 and at an angle of 45° to these conductors, the electric field component in the longitudinal direction of the conductors is loaded inductively and the electric field component tranverse of the conductors is loaded capacitively, so that the phase of the two components are shifted by given equal but opposite, amounts.

Utilizing several successively arranged layers spaced at a mutual distance of $\frac{1}{4}$ of the wavelength at the operating frequency and a given dimensioning of the meanders results, on the one hand, in a 90° phase difference between said components and, on the other hand, in the elimination of reflections of the waves from the successively arranged layers by destructive interference over a wide frequency band. The 90° phase difference between the mutual orthogonal components of the electric field results in circular polarisation. Due to the reciprocal character of the converter, a circularly polarised wave is converted in a similar manner into a linearly polarised wave.

Such a linearly polarised wave can be received at the aperture 10 substantially free of losses and supplied through the horn 9 as a $TE_{01}$ mode to the waveguide 8.

The electric field vector of a circularly polarised wave can rotate in either a clockwise or anticlockwise direction. For clockwise polarisation, the horizontal component leads the vertical one and vice-verca for anticlockwise polarisation. The polarisation converter 14, 15 converts a clockwise circularly polarised wave into a vertically polarised wave and an anticlockwise circularly polarised wave into a horizontally polarised wave.

To selectively receive each of these two types separately, the screen 14 is disposed in accordance with the invention in a holder 15 which is rotatable about the cylindrical fitting 5. By rotating the holder 45° clockwise relative to the position shown in FIG. 2 viewed from the right, clockwise circularly polarised waves are received substantially loss-free and anticlockwise circularly polarised waves are reflected by the waveguide assembly 8, 9 and 10. Turning the holder 15 45° anticlockwise from the position of FIG. 2, results in loss-free reception of anticlockwise circularly polarised waves and reflection of clockwise circularly polarised waves. All types of polarisations from clockwise circular to anticlockwise circular can thus be received substantially loss-free by rotating the holder 15 through an angle corresponding to that type of polarisation. For the position shown in FIG. 2, horizontally polarised waves are received substantially loss-free.

It should be noted that the screen 14 is not limited to the cylindrical form shown in FIG. 2. Other forms, such as a flat screen, can also be used. Likewise, the conductors 16 are not limited to the meander-shaped configuration shown in FIG. 4, but any conductor structure which forms in one direction a mainly inductive load and a mainly capacitive load in a direction perpendicular thereto can be used. Both loads need not be equally great. In the latter case, the angle at which the conductors 16 must be arranged relative to the feeder aperture to enable the reception of circularly polarised waves differs from 45° and is determined by the ratio of the arguments of the loads. In an extreme case one of these arguments may be zero.

To enable the substantial loss-free reception of vertically polarised waves by means of the feeder arrangement 2 shown in FIG. 2, the receiving device 4 is mounted for rotation in the cylindrical fitting 5 so that it can be rotated over 90°. In the rotated position, the horizontally polarised waves are reflected by the waveguide configuration 8, 9 and 10.

To enable easy rotation, the casing of the receiving device is cylindrical and is provided with a collar 18 and a groove 19 which contains in the mounted position, a locking spring 20 for retaining the receiving device 14 in the fitting 5.

Owing to the rotatable arrangement of both the converter 14, 15 and the receiving device 4, any type of polarised wave can be received substantially loss-free.

The feeder arrangement 2 is provided with a motor 21 for adjusting the angular position of the converter and receiving device by remote control to suit a particular polarised signal to be received. A motor 21, which, in this embodiment, can be adjusted step-wise, is coupled through a gearwheel transmission 22 and 23 to the receiving device 4 so that the receiving device can be moved to any desired position relative to the casing. To move the converter 14, 15 into a desired position by means of the same motor 21, the casing of the receiving device 4 is provided with a groove 24 extending over 135° of the circumference of the casing, as shown in FIG. 5. In addition, the holder 15 of the converter is provided with a key in the form of a screw 25 which projects into the groove 24. On the one hand this results in that the holder 15 is carried on by the end faces 34 and 35 of the groove 24 shown in FIG. 5 and, on the other hand, the holder 15 is fixed in the axial direction. The rotary motion of the holder 15 is limited by the end faces 34 and 35 of a recess 26 which extends over 135° of its circumference and in which the partition 7 is located.

It should be noted that it is also possible to have the holder 15 driven directly by the motor 21 and to drive the receiving device 4 by the holder on rotation by means of a similar kind of key.

The adjustments of the feeder arrangement 2 required for the most prevailing types of polarisation will be explained in greater detail with reference to the FIGS. 6*a* to 6*d* inclusive. For simplicity these figures show only the cross-section of the casing of the receiving device 4 which corresponds to the cross-section shown in FIG. 5. In these figures the plane of division of the casing of the receiving device 4 is indicated by 31. Furthermore it is assumed that instead of the recess 26 moving relative to the partition 7, the partition 7 moves relative to the recess 26. This makes it possible to combine the function of the partition 7 and the key 25 in the pin 27 shown in the figures. On the one hand, pin 27 projects into the groove 24 whose end faces 32 and 33 drive the pin on rotation and, on the other hand, it is limited in its movements by the studs 28 and 29 which represent the edges of the recess 26. The meander-shaped conductors 16 of the converter 14, 15, which is driven by the pin 27 on rotation of the receiving device 4, are symbolically represented by the grid 30.

Starting from the reference position of the feeder arrangement 2 shown in FIG. 6*a* and a rotation of half a degree of the receiving device 4 per step of the stepping motor 21, an optimum signal strength is applied to the SHF arrangement in the case of a received signal: with horizontal polarisation by having the stepping motor turn 90 steps clockwise so that the receiving device 4 rotates into the position shown in FIG. 6*b*, which corresponds with the position shown in FIG. 2. In the case of vertical polarisation, the stepping motor is driven two hundred and seventy steps to the right so that the receiving device assumes the position shown in FIG. 6*c*. With anticlockwise polarisation the stepping motor is first driven three hundred and sixty steps or degrees to the right, so that the receiving device drives the converter over 45° after a rotation over of 180° to the right and the converter is in the position shown in FIG. 6*d*. Thereafter, the stepping motor is driven ninety steps or degrees anticlockwise so that the receiving device 4 is rotated back over 45° and assumes the position shown in FIG. 6*d*. Clockwise circularly polarisated signals are received with the feed in the reference position shown in FIG. 6*a*.

FIG. 7 shows the circuit for the remote control of the stepping motor 21. This circuit includes a control circuit 38 arranged at some distance from the antenna 1, 2 and 3 shown in FIG. 1 and a circuit 39 arranged in the casing 6 of the feeder arrangement 2.

The circuit 38 comprises a pulse generator 40 which, after switch-on, supplies a continuous series of pulses directly to a first input of an AND-gate 41 and to a counter 42 having an adjustable maximum counting position. During the period prior to reaching the maximum counting position, the counter 42 supplies a high signal voltage to a second input of the AND-gate 41. On attaining the maximum counting position, the output voltage of the counter 42 changes from high to low and blocks the AND-gate 41. To have the stepping motor 21 make a desired number of steps, the counter position of counter 42 is first adjusted to the desired value and the pulse generator 40 is then started. The AND-gate 41 passes the desired number of pulses which, after amplification in amplifier 43, are applied to the switching arm of the switch 44 of a two-position change-over switch 44 and 45. In the position, not shown, of the two-position change-over switch 44 and 45 the pulses are applied to a first energizing winding 46 of the motor 21 which causes the motor 21 to make the required number of steps clockwise. In the position of the two-position change-over switch 44 and 45 shown in FIG. 7, the pulses are applied through a switch 37, which will be described hereinafter, to the position, not shown, of a second winding 47 of the motor 21 which causes the motor 21 to rotate the receiving device 4 anticlockwise.

The switch 37 is included in the circuit to ensure that the radiator is moved into the reference position when this is desired. To this end, the switch 37 is constructed as a microswitch and arranged in the casing 6 of the feeder arrangement. The gearwheel 37 is provided with a stud 36 which is positioned to open the normally closed switch 37 in the reference position of the feeder arrangement. Starting from an arbitrary setting of the feeder arrangement 2, by adjusting the counter 42 to the maximum counting position of at least three hundred and sixty and by adjusting the two-position change-over switch 47 and 45 to the position shown, the stepping motor will turn the receiving device anticlockwise until the stud 36 opens switch 37 which invariably moves the feeder arrangement 2 into the reference position. Any remaining pulses supplied by the AND-gate 41 are blocked by the open switch 37.

It should be noted that instead of the stepping motor a continuously controllable motor may be used in combination with an antenna, disposed in the waveguide 8, which is coupled to the energizing circuit of the motor for continuously controlling the position of the feeder arrangement 2 to obtain the optimum signal-to-noise ratio.

Furthermore, it should be noted that when using the stepping motor it is possible to preset to a given presetting which is adjusted non-recurrently to the optimum signal-to-noise ratio.

Furthermore, a cassegrain antenna can be used instead of the antenna shown in FIG. 1, with which the polarisation screen can be placed in front of the subreflector or in front of the horn.

What is claimed is:

1. An antenna feed system comprising a rectangular horn having a rectangular aperture, a rectangular waveguide connected to said horn, said horn and waveguide being formed from two parts joined together so that the junction therebetween is in the longitudinal symmetry plane parallel to the electric field of the $TE_{01}$ waveguide mode, a polarisation converter including a screen comprising a plurality of dielectric layers each having a conductor pattern provided thereon such that said patterns form a predominantly capacitive load for one component of the electric field of an electromagnetic wave incident on said screen, and a predominantly inductive load for a second component of said field which is perpendicular to said one component, first means for supporting said screen in front of said aperture for rotation about the longitudinal axis of said waveguide and second means for supporting said horn and waveguide connected thereto for rotation about said longitudinal axis relative to said screen.

2. The system according to claim 1 including an elongated member formed of said two parts joined at said junction and having an axially extending cavity defining said rectangular waveguide and said horn, said member being supported by said second means for rotation relative to said screen.

3. The system according to claim 2 wherein said elongated member is made of synthetic material.

4. The system according to claim 2 wherein said second means includes a first cylindrical support member having a cylindrical, axially extending cavity, said elongated member has a cylindrical portion arranged in said cylindrical cavity for rotation about said longitudinal axis of said waveguide and said first means includes a second support member mounted for rotation about said cylindrical support member relative to said elongated member, said screen being secured to said second support member for rotation therewith.

5. The system according to claim 4 including means for rotating one of said first and second support members and means for coupling the other of said first and second support members to said one of said first and second support members or rotation therewith over a predetermined angle.

6. The system according to claim 5 wherein said means for rotating includes a motor and further means for coupling said motor to said one of said first and second support members.

* * * * *

UNITED STATES PATENT AND TRADEMARK OFFICE

CERTIFICATE OF CORRECTION

PATENT NO. : 4,178,574

DATED : December 11, 1979

INVENTOR(S) : JAN W. EDENS ET AL

It is certified that error appears in the above-identified patent and that said Letters Patent are hereby corrected as shown below:

Claim 5. (line 29) after "second support members" change "or" to --for--

Signed and Sealed this

*Fifteenth* Day of *April 1980*

[SEAL]

*Attest:*

SIDNEY A. DIAMOND

*Attesting Officer*

*Commissioner of Patents and Trademarks*